United States Patent [19]

Bengtson et al.

[11] 4,051,557

[45] Oct. 4, 1977

[54] EYE PROTECTORS

[75] Inventors: Torsten R. Bengtson; Joseph Haslbeck, both of West Vancouver, Canada

[73] Assignee: International Servisport Corporation Ltd., Vancouver, Calif.

[21] Appl. No.: 600,976

[22] Filed: Aug. 1, 1975

[30] Foreign Application Priority Data

June 5, 1975 Canada ..... 228781

[51] Int. Cl.[2] ..... A61F 9/02

[52] U.S. Cl. ..... 2/430; 351/43

[58] Field of Search ..... 2/14 W, 14 C, 14 D, 2/14 E, 14 L, 14 M, 428, 430, 429, 440; 351/43, 128, 127, 140

[56] References Cited

U.S. PATENT DOCUMENTS

| | | | |
|---|---|---|---|
| 583,590 | 6/1897 | Bennett | 2/14 C |
| 1,742,412 | 1/1930 | O'Flanagan | 2/14 W |
| 1,838,646 | 12/1931 | Walsh, Jr. | 351/127 |
| 2,007,186 | 7/1935 | Farrell | 2/440 |
| 2,568,316 | 9/1951 | Brown | 2/428 |
| 2,709,256 | 5/1955 | Baratelli | 2/14 G |
| 3,672,750 | 6/1972 | Hagen | 2/14 W |
| 3,710,393 | 1/1973 | Douglas | 2/14 W |
| 3,944,345 | 3/1976 | Decorato | 351/43 |

FOREIGN PATENT DOCUMENTS

| | | | |
|---|---|---|---|
| 363,625 | 5/1906 | France | 351/128 |
| 353,761 | 10/1937 | Italy | 2/14 C |

*Primary Examiner*—Werner H. Schroeder
*Assistant Examiner*—Peter Nerbun
*Attorney, Agent, or Firm*—Larson, Taylor and Hinds

[57] ABSTRACT

A pair of eye pieces interconnected by a flexible nose strap, each eye piece being made up of a frame defining a substantially ovaloid sight opening and having a soft pad on its inner surface to act as a seal, and a transparent hood having a peripheral edge secured to the frame and enclosing the sight opening, this hood projecting outwardly from the outer surface of a frame and permitting the wearer straight ahead and peripheral vision therethrough.

9 Claims, 9 Drawing Figures

EYE PROTECTORS

Figure 1:
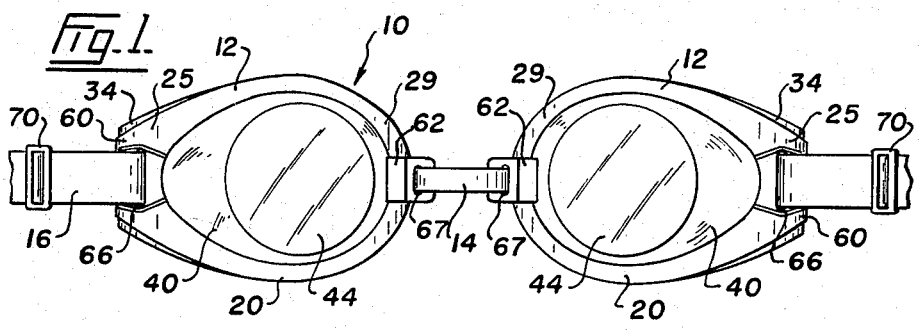

This invention relates to eye protectors, and particularly to eye goggles which are worn to protect the wearer's eyes from water, particles or the like.

The present eye protectors are designed primarily for use by swimmers and will be so described, but it is to be understood that they may be used for other purposes, such as by skiers to protect their eyes against snow, glare and cold, and by workers to protect their eyes against flying particles.

There are eye goggles on the market for swimmers, but these are not very satisfactory. They are relatively uncomfortable to wear, do not always keep water out, and tend to obscure or distort the vision. Furthermore, the shape of the prior goggles is such as to create resistance to the flow of water over and around them, thereby creating turbulence in the water ahead of the eyes which in itself obstructs the vision. The eye pieces of the prior goggles fit into the eye sockets and therefore are liable to injure the eye if accidently hit.

The present invention eliminates or greatly reduces these problems. Each eye piece of this protector is shaped to fit around the eye socket of the wearer and has seal means to prevent water from getting under the protector. This seal means is a soft pad which bears against the face so that the wearer has considerably more comfort than he would have with the prior eye pieces which fit into the eye socket. The eye piece is shaped to fit around the wearer's temple, over his brow and cheek bone, and against his nose. The eye piece includes a transparent hood which is substantially dome shaped so as to generally follow the shape of the wearer's eyeball. This adds to the comfort of the wearer since it provides a fair sized space between the eyeball and the hood. The shape of this hood is such that water resistance is greatly reduced so that there is practically no turbulence outside the hood as the protector moves through the water. The hood is preferably formed with a lens in the line of sight to allow for clear straight ahead vision. The shape of the remainder of the hood is such that it allows for good peripheral vision. This lens can be made removable in order that prescription lenses can be used if desired or necessary.

The cutting down of water resistace and the provision of good straight ahead and peripheral vision are important factors for competitive swimming. The frame, hood and lens of each eye piece are preferably molded from a single piece of plastic material so that the eye piece completely encloses the eye, thereby providing complete protection for it. This makes these eye protectors particularly useful as safety goggles. Another advantage of the present eye protectors is that the eye pieces are interconnected by a nose strap arrangement which permits the eye pieces to be quickly and readily adjusted towards and away from each other so as to fit wearers, the faces of whom are of different sizes and shapes.

The frame, hood and lens of each eye piece are preferably formed of a suitable plastic material which is strong, stiff but slightly flexible, and will not shatter if subjected to a hard blow. The thermo plastic is preferred, such as polycarbonate or acrylic. The seal pad is preferably a foamed thermoplastic or thermoset plastic, such as polyethylene, polyurethane or neoprene. This pad is compatible with the material of the eye piece frame to which it is secured.

Figure 2:
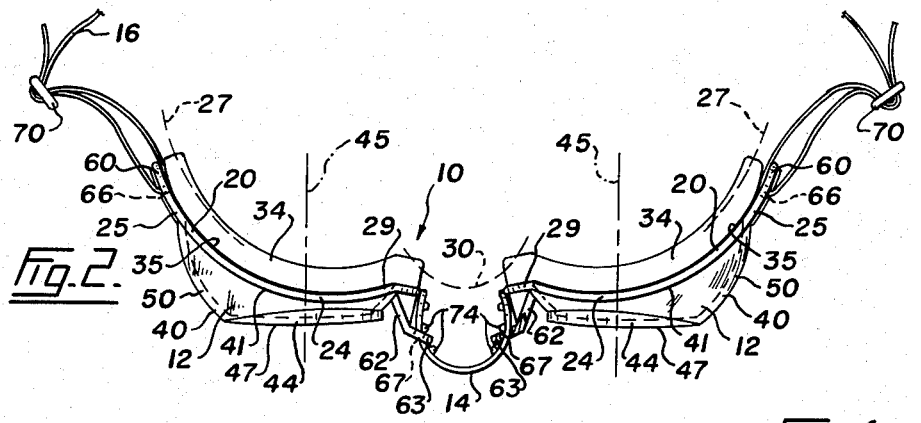
Figure 3:
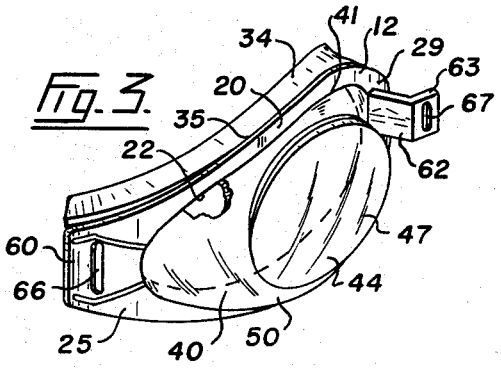
Figure 4:
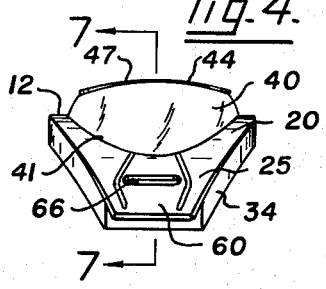
Figure 5:
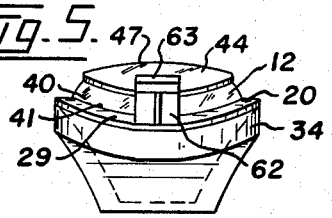
Figure 6:
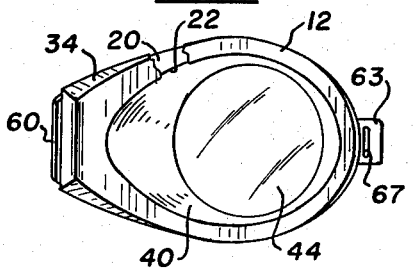
Figure 7:
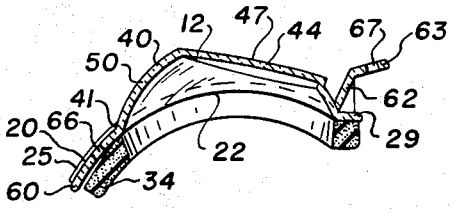
Figure 8:
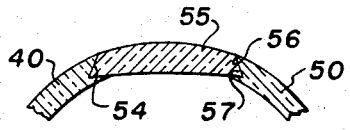
Figure 9:
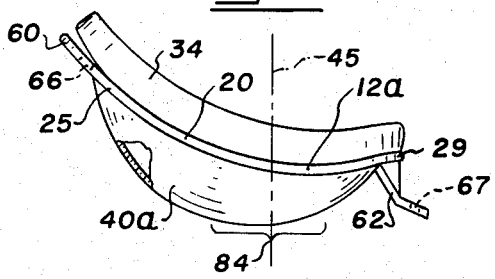

Examples of this invention are illustrated in the accompanying drawings, in which FIG. 1 is a front elevation of a preferred form of eye protector, FIG. 2 is a plan view of the protector of FIG. 1, FIG. 3 is a perspective view of an eye piece of the protector of FIG. 1, FIG. 4 is an end elevation of this eye piece, FIG. 5 is a view of the opposite end of the eye piece, FIG. 6 is a view of the eye piece from the inside, FIG. 7 is a cross sectional view taken on the line 7—7 of FIG. 4, FIG. 8 is an enlarged fragmentary section of view illustrating a variation of the eye piece of FIG. 3, and FIG. 9 is a plan view of an alternative form of eye piece.

Referring to FIGS. 1 to 7 of the drawings, 10 is a preferred form of eye protector in accordance with this invention. This eye protector is made up of two identical eye pieces 12 interconnected by a flexible nose strap 14, and a flexible band 16 is adapted to fit around the back of the wearer's head to hold the protector is place.

FIGS. 3 to 7 show one of the eye pieces 12. This eye piece consists of a relatively stiff frame 20 which defines a sight opening 22 which is of a suitable shape, and preferably of suitable ovaloid shape as shown. This frame is curved transversely as indicated at 24 in FIG. 2 so that it has an outer end 25 which substantially fits over the temple of the wearer, indicated by broken lines 27. The frame extends from the outer end to an inner end 29 which substantially extends to the wearer's nose, indicated at 30 by broken lines in FIG. 2.

A pad 34 formed of suitable soft material, such as foamed plastic material, is shaped to fit over the inner surface 35 of frame 20, and is secured to said inner surface in any desired manner, such as by a suitable adhesive. As seen in FIGS. 2, 3 and 7, this pad is relatively thick so that when the protector 10 is in place over the eyes of the wearer, the pad will deform to follow the contours of the wearer's face around the eye socket to form a seal therearound.

A transparent dome shaped hood 40 has a peripheral edge 41 which is secured to frame 20 around the sight opening 22 thereof. This hood is preferably formed with a central lens 44 which is positioned across the line of sight 45 shown in FIG. 2. This lens is substantially flat or may be slightly curved as indicated at 47. Lens 44 is preferably made to optical standards so as to virtually eliminate distortion. Hood 40 also includes a wall 50 which surrounds lens 44 and extends to frame 20. This wall is domed outwardly of frame 20, and the curve thereof is such as to follow generally the shape of the wearer's eyeball. Although lens 44 is relatively flat, it and wall 50 constitute the dome shaped hood which extends outwardly of frame 20 away from the wearer's eyeball. As best illustrated in FIGS. 2 to 5, lens 44 is axially spaced from the wall 50 at the top, bottom and innermost side, i.e., the side adjacent to the nose piece 14, and is substantially coextensive with the wall 50 at the outermost side so that hood 40 includes a transistion portion which partly surrounds and is generally coaxial with lens 44. It is shown in FIG. 2, the thickness or axial extent of this transistion portion tapers between a substantially zero depth or axial extent in the area of the outermost side of lens 44 to a greater depth or axial extent at the top (and thus the bottom) of the lens 44 and then to an intermediate depth or axial extent at the side of lens 44 adjacent to nost piece 14.

If desired, frame 20 can be omitted so that the peripheral edge 41 of the hood becomes in effect the rigid frame, in which case pad 34 would be pressed against said edge and adhesively secured thereto or molded therewith.

As shown in FIGS. 1 to 7, frame 20, hood 40 with its wall 50 and lens 44 are molded from a single piece of plastic material. However, the lens may be made removable, as shown in FIG. 8. In this example, the wall 50 of hood 40 is formed with a substantially circular opening 54 in the line of sight, and a lens 55 is formed with an edge 56 shaped to fit in a peripheral groove 57 in the edge of wall 50 defining opening 54 so that the lens can be snapped into place. This allows for the changing of the lens if desired, and if a person requires prescription lenses, they can be made and fitted into this eye protector.

Frame 20 is formed with a lug 60 projecting outwardly from its outer end 25. In addition, frame 20 is formed with a lug 62 on its inner end 29 and projecting outwardly from the frame, as clearly shown in FIGS. 2, 3 and 7. The lug 62 is formed with an angularly arranged portion 63 at its outer end. Slots 66 and 67 are formed in lugs 60 and 63, respectively.

Referring to FIG. 2, it will be seen that ends of band 16 are threaded through the slots 66 in the frame outer lugs 60. Portions of band 16 near the opposite ends thereof are threaded through a standard connector 70 as are the ends of the band after passing through the lug slots. These connectors 70 permit the adjustment of the effective length of band 16 to suit the individual wearer of the protector.

Nose strap 14 is threaded through slots 67 of the two adjacent inner lugs 62 of the eye pieces. The nose strap or piece is formed with a plurality of stops 74, see FIG. 2, projecting outwardly from the inner surface thereof and spaced longitudinally of the strap. These stops are of such size and rigidity as normally to prevent movement of the nose strap through lug slots 67, but they are of such size and flexibility as to pass through the slots for adjusting purposes when the nose strap is subjected to a strong longitudinal pull. Thus, the effective length of nose strap 14 may be adjusted to suit the wearer.

When the eye protector 10 is worn, band 16 fits around the back of the wearer's head and pulls eye pieces 12 against his face. The frames 20 and pads 34 of the eye piece are of such shape and size and they fit around the eye socket of the wearer, although the inner ends of the frames and the pads are positioned so that the pads contact the sides of the wearer's nose. The outer ends of the pads and frames fit over the wearer's temples, and the upper end lower portions of the pad are pressed against the wearer's brow and cheek, respectively. The softness of pads 34 enable them to follow the contours of the face so that they act as a seal to keep moisture away from the eyes.

When the protector or goggles 10 is in place, the two lenses 44 are positioned in the line of sight and extend across it so that they do not obstruct or distort straight ahead vision. As the curvature on walls 50 of hood 40 generally follow the shape of the eyeball, the wearer can see laterally. The peripheral vision is improved with the goggles of the present application from that encountered in prior art goggles having an ovaloid shaped opening at the rim. As hoods 40 project outwardly from frames 20, they leave a space in front of each eyeball so that the hoods and lenses are not uncomfortably close to the eyes. The general dome shape of hoods 40 have a streamlining effect so that the water flows over them without undue turbulence.

It is very advantageous for some wearers to have prescription lenses, and the alternative of FIG. 8 makes this possible.

FIG. 9 shows another alternative eye piece **12*a*. In this example, frame 20 and lugs 60 and 62 are the same as those of eye piece 12, but the hood 40*a* is completely dome shaped. The portion 84 of hood 40*a* is in the line of sight and constitutes the lens of this unit. The hood 40*a* provides a very nice streamline effect, but the lens arrangement is not for some purposes as satisfactory as that of eye piece 12**.

It is claimed:

1. An eye protector for use in swimming and adapted to provide the minimum reduction in vision of the wearer, to be a close fit around the eye of the wearer and to permit streamline flow over the exterior surface of the protector, the protector comprising a pair of separate eye pieces interconnected at inner ends by a nose piece, each eye piece comprising an integrally formed body of a transparent material, said body comprising a stiff, curved, relatively wide rim dimensioned to fit around an eye socket of the wearer, under the brow and on top of the check bone and transversely curved to fit over the temple of a wearer and against the side of the nose of the wearer; an ovaloid opening defined at the inner periphery of the rim; a generally dome shaped hood, extending outwardly from the inner periphery of the rim and enclosing the eye opening in the rim for permitting straight ahead and peripheral vision therethrough, said hood including at least first and second portions, said first portion comprising a lens portion having a relatively large radius of curvature and being located substantially directly in line with the line of sight of the wearer and said second portion comprising a bulbous dome shaped wall portion which surrounds said lens portion and extends to the inner periphery of said rim, the curvature of the wall portion being substantially greater than that of said lens portion and following generally that of the eyeball of a wearer, said hood further comprising a third portion located between said first and second portions, at least part of said first portion being spaced from said second portion and said third portion comprising a transition between said first and second portions, a sealing pad formed on the inner side of the rim dimensioned to contact the face of the wearer under the brow, on top of the checkbone, over the temple and against the side of the nose of the wearer so as to provide an underwater seal around the eye, said pad being soft enough to conform to a wearer's face around the eye socket to seal each eye piece; a connector means on the outer end of the frame and a flexible strap secured to said connector means to extend around the back of the wearer's head to hold the eye piece in position over the eye sockets.

2. An eye protector as claimed in claim 1 wherein said lens portion is generally circular as viewed in plan and is slightly curved in transverse cross-section.

3. An eye protector as claimed in claim 2 wherein said third portion is substantially coaxial with the optical axis of said lens portion and wherein the axial extend of said third portion is greater at the top and bottom thereof than on the sides.

4. An eye protector as claimed in claim 3 wherein said first portion and said second portion are substantially coextensive at the outer side of said first portion and the axial extent of said third portion tapers between substantially zero axial extent at said outer side to a greater axial extent in the area of the top and bottom of the first portion and to an intermediate axial extent at the inner side of said first portion.

5. An eye protector as claimed in claim 1 wherein said first and second portions are substantially coextensive of the outer edge of said first portion and said first portion is offset inwardly with respect to the center of said second portion and lies closely adjacent to but spaced from the innermost edge of said inner periphery of said rim.

6. An eye protector as claimed in claim 1 in which said nose piece comprises a flexible strap.

7. An eye protector as claimed in claim 1 including rigid lugs on the inner ends of the frames and projecting outwardly therefrom, said nose piece comprising a flexible strap interconnecting outer ends of said rigid lugs.

8. An eye protector as claimed in claim 1 including rigid lugs on the inner ends of the frames and projecting outwardly therefrom, and a slot in each rigid lug adjacent an outer end thereof, said nose piece comprising a flexible strap extending through said slots and connecting to the lugs.

9. An eye protector as claimed in claim 1 including rigid lugs on the inner ends of the frames and projecting outwardly therefrom, and a slot in each rigid lug adjacent an outer end thereof, said nose piece comprising a flexible strap extending through said slots and having a plurality of stops projecting outwardly therefrom spaced apart longitudinally thereof, said stops being of such size and rigidity as normally to prevent movement of the nose strap through the lug slots but being of such size and flexibility as to pass through the slots for adjusting purposes when the nose strap is subjected to a strong longitudinal pull.

* * * * *

UNITED STATES PATENT OFFICE

CERTIFICATE OF CORRECTION

PATENT NO. : 4,051,557

DATED : October 4, 1977

INVENTOR(S) : Bengtson, T.R. and Haslbeck, J.

It is certified that error appears in the above-identified patent and that said Letters Patent are hereby corrected as shown below:

On the Cover Page, rewrite the identification of Assignee as follows:

[73] Assignee: INTERNATIONAL SERVISPORT CORPORATION LTD.
Vancouver, Canada and

HIGHLAND MFG. COMPANY LTD.
Burnaby, Canada

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*